US007296856B2

(12) United States Patent
Rozaieski et al.

(10) Patent No.: US 7,296,856 B2
(45) Date of Patent: Nov. 20, 2007

(54) RECLINING SEAT WITH MOVABLE BACK SUPPORT

(75) Inventors: Michael J. Rozaieski, Drums, PA (US); George A. Turturiello, Honesdale, PA (US); Corey M. Blauch, Dallas, PA (US)

(73) Assignee: Pride Mobility Products Corporation, PA (US)

( * ) Notice: Subject to any disclaimer, the term of this patent is extended or adjusted under 35 U.S.C. 154(b) by 0 days.

(21) Appl. No.: 10/959,467

(22) Filed: Oct. 6, 2004

(65) Prior Publication Data

US 2005/0088024 A1 Apr. 28, 2005

Related U.S. Application Data

(60) Provisional application No. 60/509,501, filed on Oct. 8, 2003.

(51) Int. Cl.
*A47C 1/024* (2006.01)
*A47C 3/00* (2006.01)

(52) U.S. Cl. ..... 297/354.12; 297/358

(58) Field of Classification Search ..... 297/358, 297/362.13, 354.1, 354.12, 284.7, 362.12
See application file for complete search history.

(56) References Cited

U.S. PATENT DOCUMENTS

| | | | | |
|---|---|---|---|---|
| 114,199 | A | 4/1871 | Richardson | |
| 3,095,235 | A | 6/1963 | Babcock et al. | |
| 3,112,001 | A | 11/1963 | Wise | |
| 3,147,038 | A | 9/1964 | Barabas | |
| 3,630,569 | A | 12/1971 | Lory et al. | |
| 3,880,463 | A * | 4/1975 | Shephard et al. | 297/284.7 |
| 4,079,990 | A | 3/1978 | McMunn et al. | |
| 4,099,277 | A | 7/1978 | Watkins | |
| 4,153,292 | A | 5/1979 | White et al. | |
| 4,183,578 | A | 1/1980 | Naganawa | |
| 4,285,541 | A | 8/1981 | Onishi | |
| 4,339,013 | A | 7/1982 | Weigt | |
| 4,593,929 | A | 6/1986 | Williams | |
| 4,655,471 | A | 4/1987 | Peek | |
| 4,679,849 | A | 7/1987 | Torgny | |
| 4,691,962 | A | 9/1987 | Holdt | |
| 4,759,561 | A | 7/1988 | Janssen | |
| 4,790,716 | A | 12/1988 | McConnell | |
| 4,795,214 | A | 1/1989 | Holdt | |
| 4,862,529 | A | 9/1989 | Peck | |
| 4,949,408 | A | 8/1990 | Trkla | |
| 4,966,379 | A | 10/1990 | Mulholland | |
| 5,011,175 | A | 4/1991 | Nicholson et al. | |

(Continued)

FOREIGN PATENT DOCUMENTS

| | | |
|---|---|---|
| EP | 0 463 652 A | 1/1992 |
| EP | 0 841 053 A | 5/1998 |

*Primary Examiner*—Joe Edell
(74) *Attorney, Agent, or Firm*—DLA Piper US LLP

(57) ABSTRACT

A reclining seat includes a base, a back frame and back support connected to the back frame for translation relative to the back frame. In a first embodiment, a mechanism is provided to couple the back frame to the back support such that rotation of the back frame relative to the base automatically translates the back support relative to the back frame. In a second embodiment, a mechanism is provided to allow a user to control movement of the back support independently of back frame rotation. Preferably, the reclining seat is incorporated into a wheelchair.

10 Claims, 8 Drawing Sheets

U.S. PATENT DOCUMENTS 5,020,816 A 6/1991 Mulholland
5,044,647 A 9/1991 Patterson
5,050,899 A 9/1991 Stensby
5,181,762 A 1/1993 Beumer
5,195,803 A 3/1993 Quintile
5,215,352 A 6/1993 Yeh et al.
5,261,725 A 11/1993 Rudolph
5,263,768 A 11/1993 Scheulderman
5,292,144 A 3/1994 Sosnoff
5,294,141 A 3/1994 Mentessi et al.
5,297,021 A 3/1994 Koerlin et al.
5,320,412 A 6/1994 Eakins et al.
5,328,183 A 7/1994 Counts
5,374,101 A 12/1994 Wiecek
5,549,357 A 8/1996 Counts et al.
5,556,121 A 9/1996 Pillot
5,556,157 A 9/1996 Wempe
5,575,348 A 11/1996 Goertzen et al.
5,577,805 A 11/1996 Glinter et al.
5,601,302 A 2/1997 Beard et al.
5,634,688 A 6/1997 Ellis
5,673,967 A 10/1997 Wempe
5,762,356 A 6/1998 Kunze et al.
5,772,226 A 6/1998 Bobichon
5,790,997 A 8/1998 Ruehl
5,823,621 A 10/1998 Broadhead
5,868,461 A 2/1999 Brotherston
5,909,926 A 6/1999 Gonzalez
5,971,482 A 10/1999 Goertzen et al.
5,997,021 A 12/1999 Robinson et al.
6,003,891 A 12/1999 Broadhead
6,015,189 A 1/2000 Broadhead et al.
6,032,976 A 3/2000 Dickie et al.
6,119,980 A 9/2000 Ferry
6,126,186 A 10/2000 Mascari
6,129,415 A 10/2000 Galloway
6,154,899 A 12/2000 Brooke et al.
6,158,810 A * 12/2000 Galloway ..... 297/354.1
6,206,393 B1 3/2001 Mascari et al.
6,220,615 B1 4/2001 Chubbuck
6,250,717 B1 6/2001 Porcheron
6,296,263 B1 10/2001 Schultz et al.
6,352,273 B1 3/2002 Dickie
6,357,776 B1 3/2002 Goertzen et al.
6,390,554 B1 5/2002 Eakins et al.
6,409,265 B1 6/2002 Koerlin et al.
6,425,635 B1 7/2002 Pulver
6,450,581 B1 9/2002 Koerlin
6,527,340 B1 3/2003 Finch et al.
6,540,250 B1 4/2003 Peterson

* cited by examiner

RECLINING SEAT WITH MOVABLE BACK SUPPORT

CROSS REFERENCE TO RELATED APPLICATIONS

This application claims benefit of the filing date of U.S. Provisional Patent Application 60/509,501, "Reclining Seat with-Shear Adjustment", filed Oct. 8, 2003, the subject matter of which is incorporated herein by reference.

FIELD OF THE INVENTION

The invention relates to reclining seats, and especially a seat for a wheelchair that has a reclining back. The invention relates in particular to a seat in which the seat back moves up and down, either automatically or under control of a user, as the angle of recline is adjusted, to reduce the shear between the back of the user and the seat back.

BACKGROUND OF THE INVENTION

In an ordinary seat with a reclining back, the seat back typically pivots about an axis that is roughly at the intersection of the frames of the seat back and the seat base. When an occupant of the seat rests against the seat back as it reclines, the occupant's torso rotates about his or her hip joints. The separation between the pivot axis about which the seat back rotates and the user's hip joint pivot axis about which the user's back rotates results in the seat back sliding upwards relative to the user's back as the seat back is reclined backwards, and downwards as the seat back is raised towards the upright position. This is known as "shear." For most occupants, this is not a major problem. The occupant simply moves his or her torso so as to allow it to shift relative to the seat back.

However, for persons of limited mobility, including many users of power wheelchairs, the necessary shift in position is less easy. There is therefore a need for a reclining seat back, especially for wheelchairs, in which the shear between the seat back and the user's back is reduced. Various solutions have been proposed, including mechanisms to bring the pivot axis of the seat back nearer to the user's hip joint pivot axis, as well as mechanisms for sliding the seat back cushion up and down relative to the seat back frame as the seat back reclines. It is believed that a novel, simple, and robust mechanism capable of translating a back support relative to a back frame would be desirable.

SUMMARY OF THE INVENTION

In a first aspect, the invention is a reclining seat comprising a base and a back frame pivotally coupled to the base for rotation about a first pivot axis. A back support is slidingly coupled to the back frame for translation relative to the back frame. A mechanism includes a first portion and a second portion. The first portion has a support member pivotally coupled at a first end to the back frame at a first connection point and coupled to the second portion at a second end. The second portion has a first end pivotally coupled to the base at a second connection point and has a second end coupled to the back support. The second portion has a length from the first end to the second end in a direction extending between the first and second connection points. The length of the second portion is variable. Rotation of the back frame relative to the base varies the length of the second portion and translates the back support relative to the back frame.

The support member may be a rigid structural member. Alternatively, the support member may be a linear actuator, and operation of which is selectively controllable, allowing the back support to translate independently of rotation of the back frame. Preferably, the back support includes a pair of tracks, and the second portion includes a linkage, having first, second, third and fourth links, each link having a first end and a second end, the first and second links being rotatably coupled to the base at their respective first ends and rotatably coupled at their second ends to the first ends of the third and fourth links, respectively, the third and fourth links being rotatably coupled at points intermediate their first and second ends, and the second ends of the third and fourth links being slidably coupled to the back support tracks.

Preferably, the back frame is coupled to the base at a first end of the back frame and rotation of the back support frame relative to the base from an upright position into a reclined position translates the back support toward the first end of the back frame. An actuator may be coupled to the base and to the back frame to rotate the back frame relative to the base.

In a second aspect, the invention is a reclining seat comprising a base and a back frame pivotally coupled to the base for rotation about the base along a first pivot axis. A back support is slidingly coupled to the back frame for translation relative to the back frame. The back support has a lower end proximate the base and an upper end distal the base. A central axis extends between the lower and upper ends. A pair of tracks is provided, each track having a longitudinal centerline symmetrically oriented at an angle relative to the back support central axis in generally a V-shaped arrangement. A linkage is formed by first, second, third, and fourth links. Each of the links has a first end and a second end. The first and second links are rotatably coupled to the base at their respective first ends and rotatably coupled at their respective second ends to the first ends of the third and fourth links. The second ends of the third and fourth links are slidably coupled to the back support tracks. A support member is pivotally coupled at a first end to the back frame and coupled at a second end to the linkage. An actuator is coupled to the base and to the back support frame to rotate the back support frame relative to the base. Rotation of the back frame relative to the base from an upright position into a reclined position translates the back support toward the first end of the back frame.

In a third aspect, the invention is a reclining seat comprising a base and a back frame pivotally coupled to the base for rotation about a first pivot axis. A back support is slidingly coupled to the back frame for translation relative to the back frame. The back support has a lower end proximate the base and an upper end distal the base. A central axis extends between the lower and upper ends. A pair of tracks is provided, wherein each track has a longitudinal centerline symmetrically oriented at an angle relative to the back support central axis in generally a V-shaped arrangement. A first actuator is coupled to the base and to the back frame to rotate the back frame relative to the base. A linkage comprises at least a first link and a second link. Each link has a first end and a second end. The first and second links are pivotally coupled together proximate their respective first ends. The first and second links are slidingly engaged with the first and second tracks, respectively, proximate their respective second ends. A second actuator is operatively coupled to the first and second links to rotate the first and second links relative to one another. A support member is pivotally coupled at a first end to the back frame and coupled at a second end to the linkage. Rotation of the first and second links causes the first ends to move within the first and second tracks, causing translation of the back support relative to the back frame.

In yet a fourth aspect, the invention is a reclining seat comprising a base and a back frame pivotally coupled to the base for rotation about a first pivot axis. A back support is slidingly coupled to the back frame for translation relative to the back frame. A mechanism is pivotally coupled at a first end to the back frame and pivotally coupled to the base at a second end for rotation about a second pivot axis. The mechanism is coupled to the back support at a point intermediate the first and second ends. The mechanism has a length from the first end to the second end, with the length being variable. Rotation of the back frame relative to the base varies the length of the mechanism and translates the back support relative to the back frame.

BRIEF DESCRIPTION OF THE DRAWINGS

For the purpose of illustrating the invention, there is shown in the drawings a form of the invention which is presently preferred; it being understood, however, that this invention is not limited to the precise arrangements and instrumentalities shown. In the drawings.

DETAILED DESCRIPTION OF THE DRAWINGS

Figure 1:
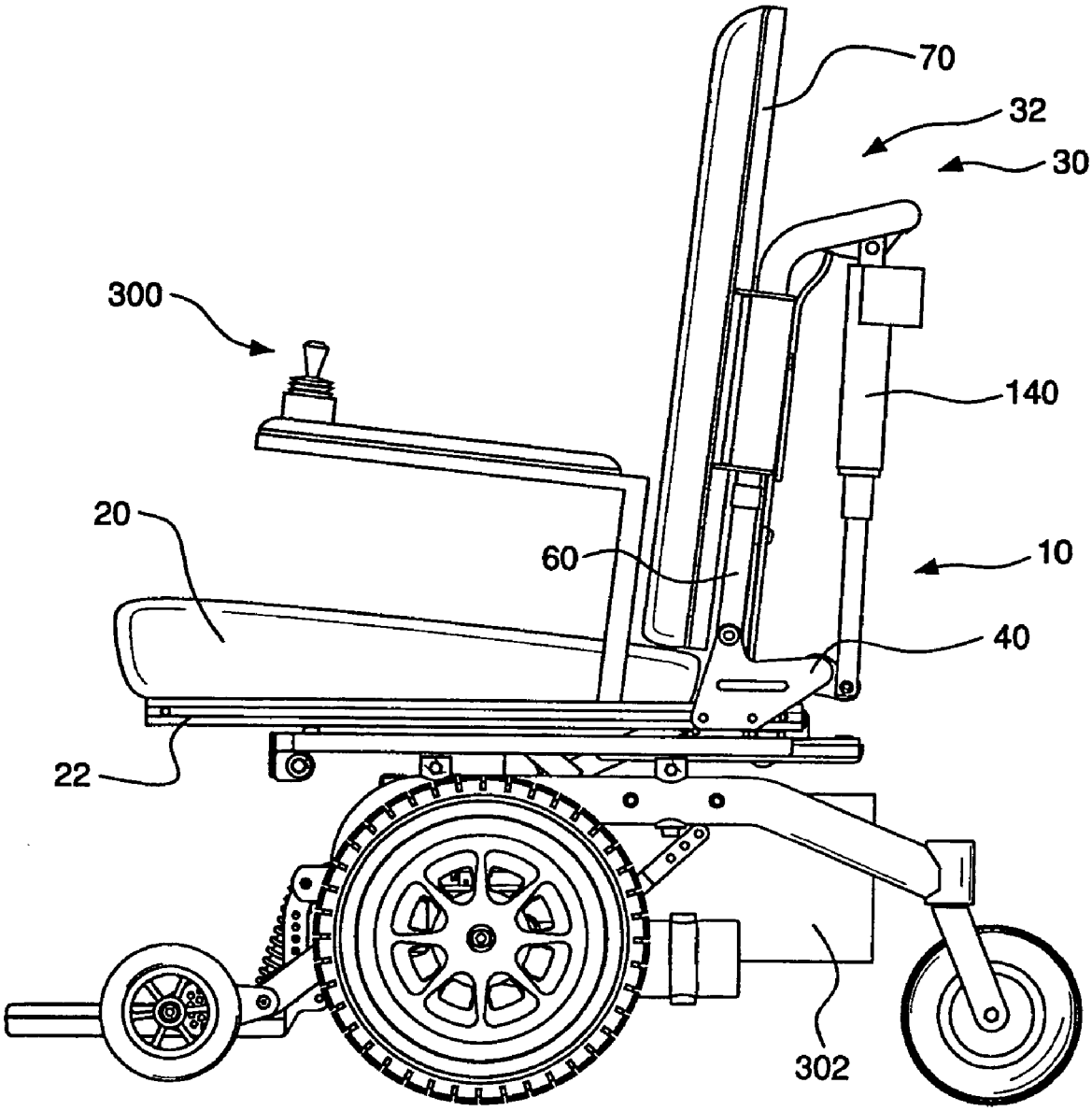
FIG. 1 is a side view of a wheelchair having a reclining seat assembly.

Referring to the figures, wherein like numerals are used to indicate like elements throughout, there is shown in FIGS. 1-9 a reclining seat assembly 10 capable of being provided with either of two preferred embodiments of a back support translation mechanism in accordance with the present invention. With particular reference to FIGS. 1-7, the reclining seat assembly 10 comprises a seat bottom 20 and a backrest assembly 30 having a base 40, a back frame 60, a back support 70, a back support translation mechanism 90 and a first actuator 140. Preferably, the reclining seat assembly 10 is incorporated into a wheelchair 300 having an electrical power supply in the form of a battery 302.

Figure 2:
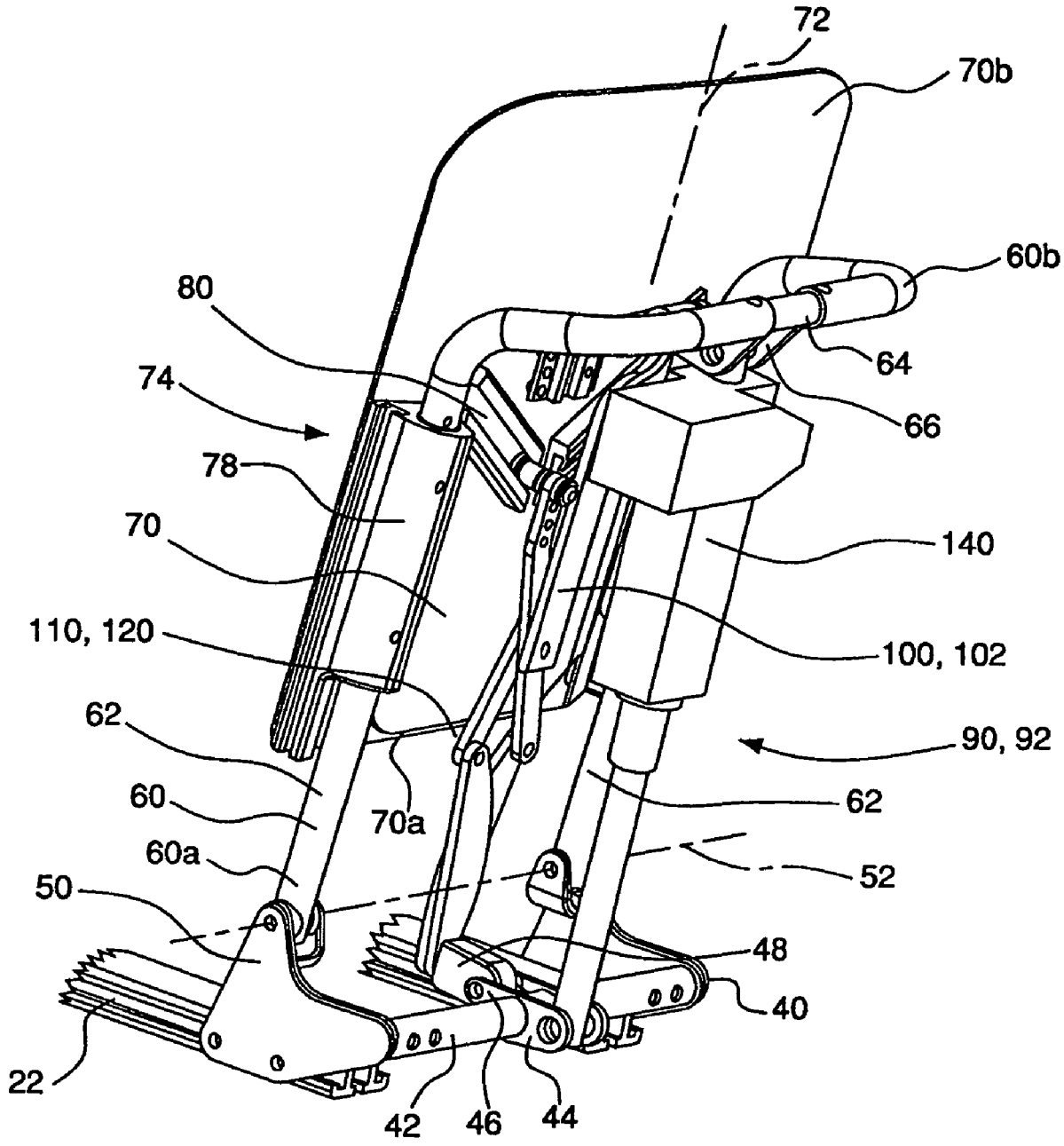
FIG. 2 is a rear perspective view of a backrest assembly, shown in an upright position, having a back support translation mechanism in accordance with a first preferred embodiment of the present invention.

With particular reference to FIGS. 1 and 2, the reclining seat 10 includes the seat bottom 20, which is supported by a seat frame 22, and the backrest assembly 30. The backrest assembly 30 is movable between an upright position 32 and a reclined position 34 (see FIGS. 6 and 7). The base 40 includes a base cross member 42 having first and second opposing ends. An actuator mount 44 and linkage mount 46 extend from the base cross member 42 intermediate the first and second opposing ends. The actuator mount 44 allows the first actuator 140 to be pivotally coupled to the base cross member 42. The first actuator 140 is preferably electrically-operated, and operatively coupled to the battery 302. The back rest translation mechanism 90 is coupled to the base cross member 42 by a connector 48 pivotally coupled to the linkage mount 46. The base 40 further includes a pair of back frame mounts 50 coupled to the first and second opposing ends of the base cross member 42.

The back frame 60 is pivotally coupled to the base 40 at the back frame mounts 50 for rotation about a first pivot axis 52. The back frame 60 has a first, lower end 60*a* and a second, upper end 60*b*. The back frame 60 is generally U-shaped, having first and second upright members 62 connected by a back frame cross member 64. The back frame cross member 64 is positioned to be grasped by a person standing behind the wheelchair 300 proximate the back frame 60, allowing the person to manually push or turn the wheelchair 300. The back frame 60 preferably includes an actuator mount 66 and a support member mount 68 (see FIG. 3, in which the first actuator 140 has been omitted for clarity), each extending from the back frame cross member 64.

Figure 3:
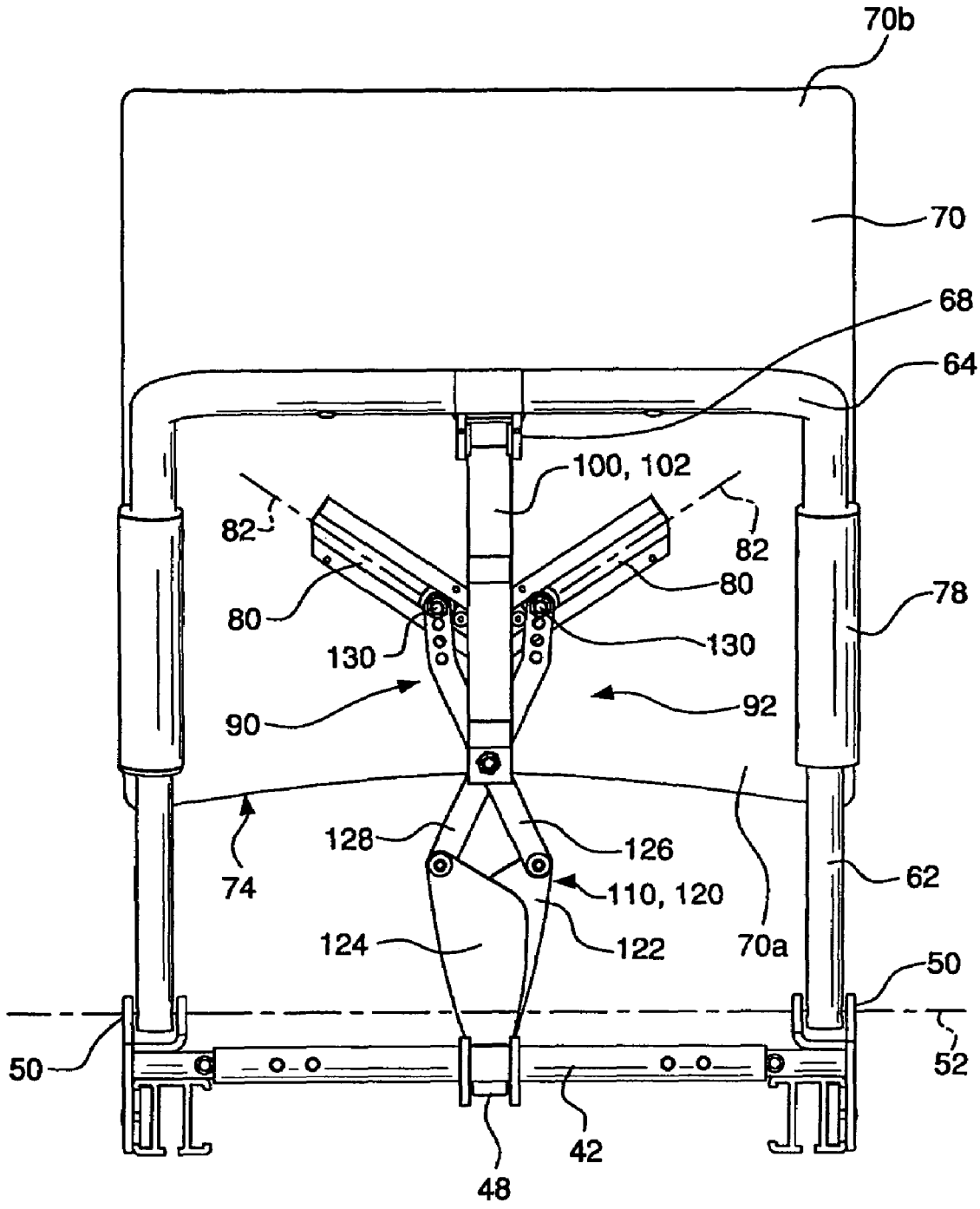
FIG. 3 is a rear elevational view of the backrest assembly of FIG. 2. An actuator of the backrest assembly is omitted from FIG. 3 for clarity.
Figure 4:
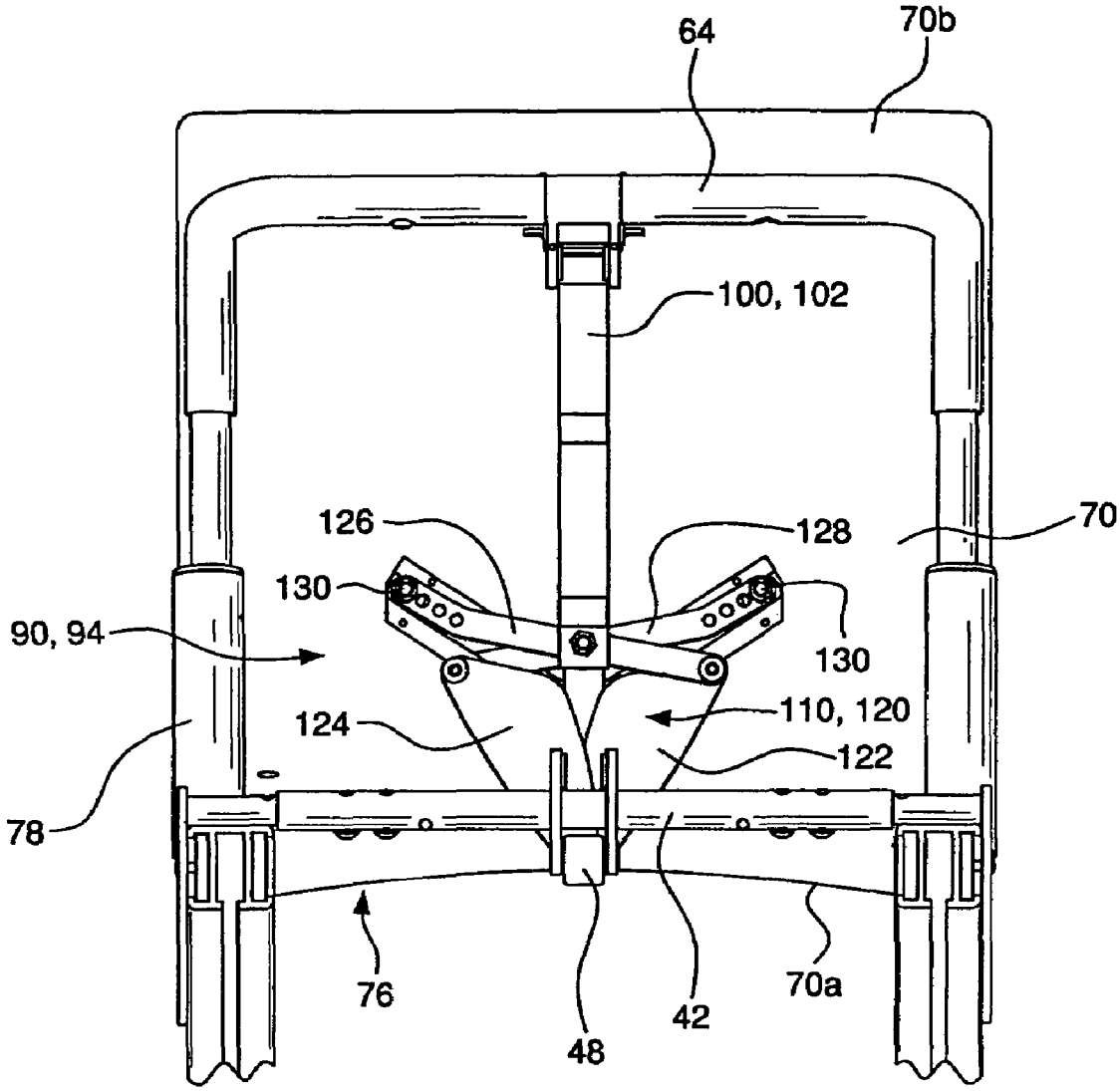
FIG. 4 is a rear elevational view of the backrest assembly of FIG. 3, showing the backrest assembly in a reclined position.

With particular reference to FIGS. 2-4, the back support 70 is slidingly coupled to the back frame 60 for translation relative to the back frame 60 between a first, upright position 74, corresponding to the backrest assembly upright position 32, and a second, reclined position 76 corresponding to the backrest assembly reclined position 34. The back support 70 has a first, lower end 70*a* and a second, upper end 70*b*. A central axis 72 extends between the lower end 70*a* and upper end 70*b*, and divides the back support 70 into left-hand and right-hand portions. The back support 70 is preferably coupled to the back frame 60 by a pair of mounting sleeves 78, sized and shaped to slidingly engage the upright members 62.

A pair of tracks 80 are provided on a rear face of the back support 70. The tracks 80 may be formed integrally with the back support 70, or may be formed separately, and joined to the back support 70. Preferably, each track of the pair of tracks has a longitudinal centerline 82, and the tracks are symmetrically oriented at an inclination angle $\alpha$ relative to the back support central axis in generally a V-shaped arrangement. In the embodiment illustrated, the V-shape points downward. Preferably, the tracks 80 form generally C-shaped channels.

Figure 5:
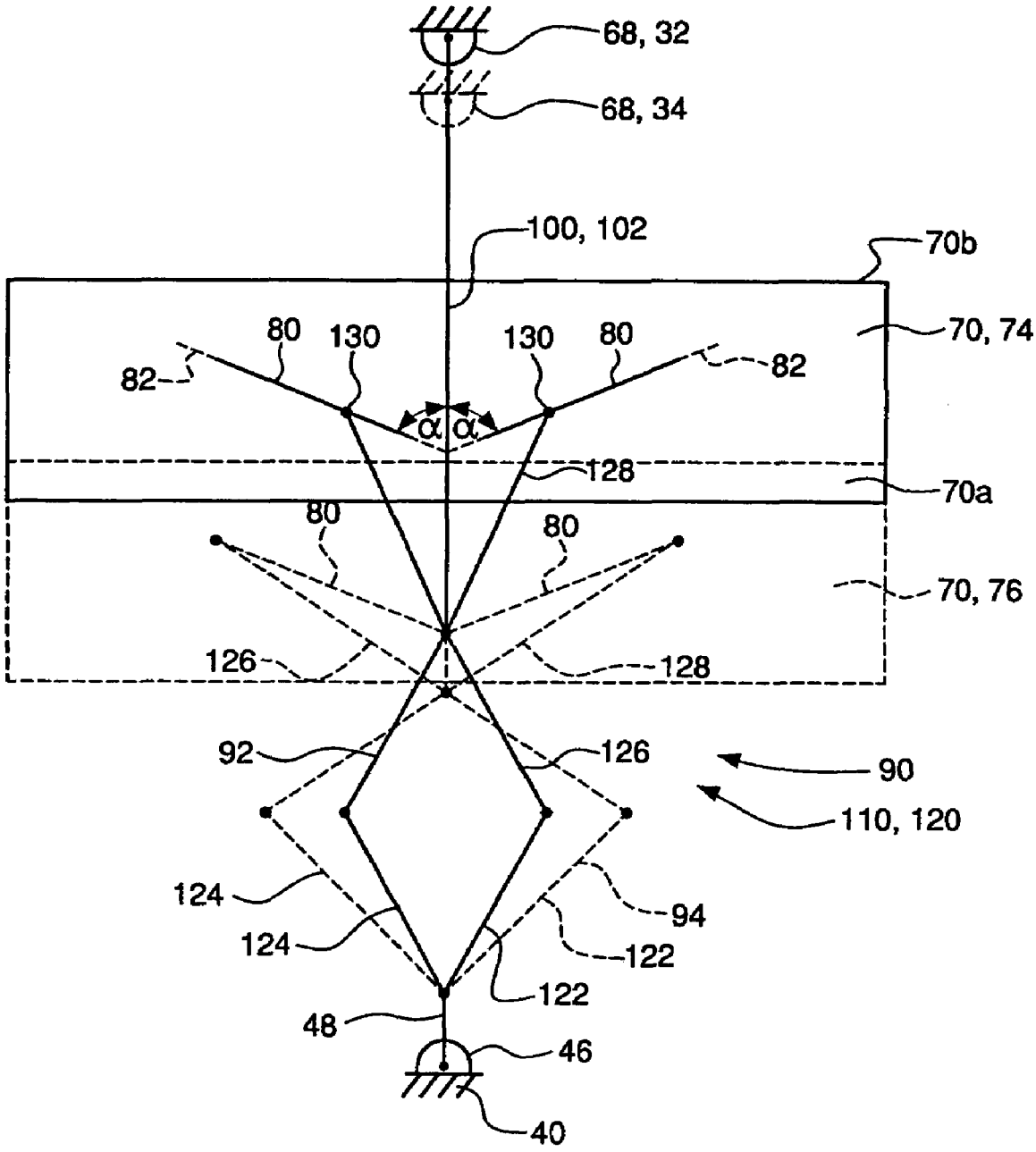
FIG. 5 is a schematic representation of the back support translation mechanism of FIGS. 2-4.

With particular reference to FIGS. 3-5, the back support translation mechanism 90 is capable of movement between a first, raised position 92 corresponding to the back support upright position 74, and a second, lowered position 94 corresponding to the back support reclined position 76. The mechanism 90 includes a first portion 100 and a second portion 110. The first portion 100 has a support member 102 pivotally coupled at a first end at a first connection point to the back frame 60 at the support member mount 68. At a second end, the support member 102 is coupled to the second portion 110.

The second portion 110 has a first end pivotally coupled to the base 40 at a second connection point at the linkage mount 46 through the connector 48 for rotation about a second pivot axis. The second portion 110 has a second end coupled to the back support 70. Preferably, the second portion 110 includes a linkage 120, having a first link 122, a second line 124, a third link 126 and a fourth link 128.

Each link 122-128 has a first end and a second end. The first and second links 122, 124 are preferably rotatably coupled to the base 40 at their respective first ends and rotatably coupled at their second ends to the first ends of the third and fourth links 126, 128, respectively. The third and fourth links 126, 128 are rotatably coupled at points intermediate their first and second ends. The second ends of the third and fourth links 126, 128 are slidably coupled to the back support tracks 80. Preferably, the third and fourth links 126, 128 are coupled to the back support tracks 80 by followers 130. The followers 130 are preferably generally disk-shaped rollers rotatably mounted to the third and fourth links 126, 128 and received within the tracks 80.

Figure 6:
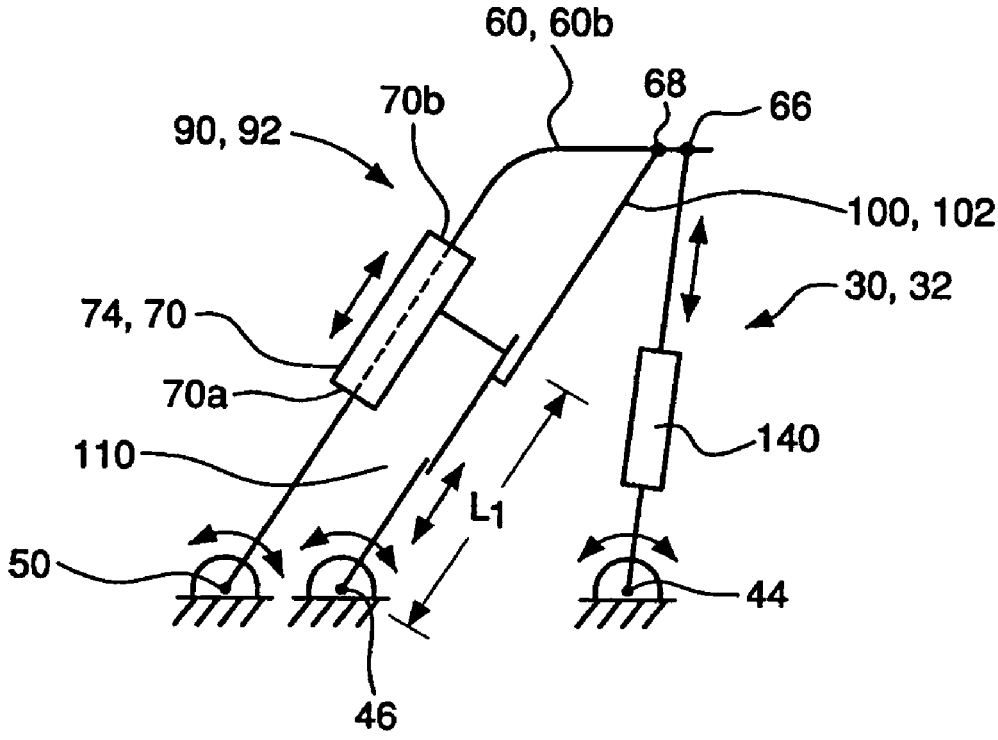
FIG. 6 is a schematic representation of the backrest assembly of FIG. 2.
Figure 7:
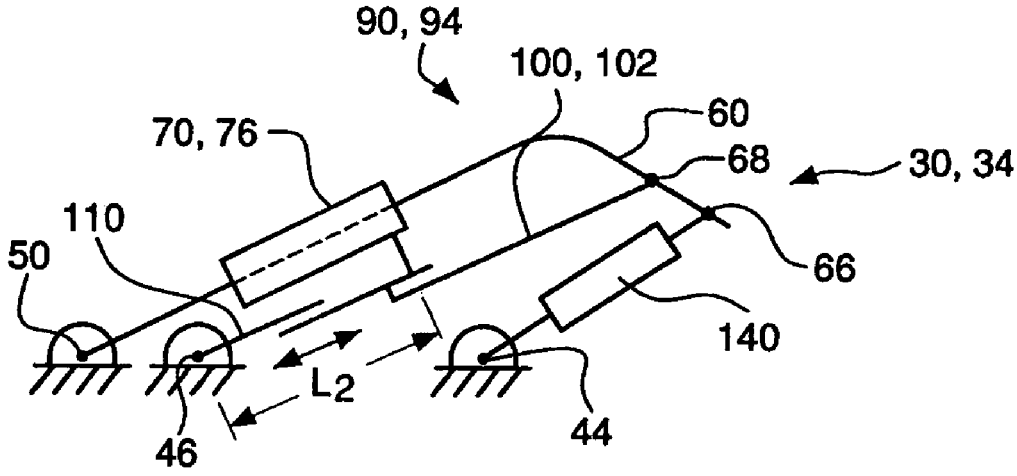
FIG. 7 is a schematic representation of the backrest assembly of FIG. 4, with the actuator included.

With particular reference now to FIGS. 6 and 7, the second portion 110 has a length from the second portion first end to the second portion second end in a direction extending generally between the first and second connection points. This length is variable, with a first length L1 (corresponding to the backrest assembly 30 being in its upright position 32) being greater than a second length L2 (corresponding to the backrest assembly 30 being in its reclined position 34). As discussed below in detail, rotation of the back frame 60 relative to the base 40 varies the length of the second portion 110 and translates the back support 70 relative to the back frame 60.

With reference now to FIGS. 5-7, the back support translation mechanism 90 is operated as the backrest assembly 30 moves between its upright position 32 and its reclined position 34 by the first actuator 140. When the backrest assembly 30 is in its upright position 32, the back support translation mechanism 90 is in its raised position 92 and the second portion 110 has a length equal to first length L1. As the actuator 140 retracts, rotating the back frame 60 into the reclined position 34, the back support translation mechanism 90 is moved into the lowered position 94, moving the second portion 110 into a position having length L2. The back support 70 is coupled to the second portion 110, and the position of the back support 70 relative to the back frame 60 is directly related to the overall length of the second portion 110. As the length of the second portion 110 shortens, the back support 70 is translated relative to the back frame 60 from its upright position 74 towards its reclined position 76.

With particular reference to FIG. 5, as the backrest assembly 30 moves from its upright position 32 into its reclined position 34 (indicated in phantom), the back support translation mechanism 90 moves from its raised position 92 into its lowered position 94 (shown in phantom). In moving from upright position 32 into reclined position 34, the support member 102 is moved toward the base 40, moving the linkage 120 in a manner such that the second ends of the third and fourth links 126, 128, coupled to the back support tracks 80 by the followers 130, slide upwardly away from the back support lower end 70*a* and outwardly away from the center of the back support 70. With that movement of the third and fourth links, the back support 70 is pulled downwardly, toward the back frame lower end 60*b*. Conversely, as the backrest assembly moves from the reclined position 34 to the upright position 32, the back support translation mechanism 90 is moved from the lowered position 94 to the raised position 92, in turn moving the back support 70 from the reclined position 76 into the upright position 74.

Depending on the arrangement of the linkage 120 (in particular, relative lengths of the links 122-128 and positioning of the pivotal coupling between the third and fourth links 126, 128) and also depending upon arrangement of the tracks 80 (in particular, the inclination angle $\alpha$), the linkage 120 can be made to multiply movement of the back support 70 relative to movement of the support member 102. That is, for example, a one inch movement of the support member 102 can result in a four inch movement of the back support 70. Adjustment of the inclination angle $\alpha$, or of effective lengths of the links 122-128, or of position of the position of the fulcrum between the third and fourth links 126, 128 can permit movement of the back support 70 to be tailored to individual users. In particular, with reference to FIGS. 3 and 4, the third and fourth links 126, 128 may each be provided with a plurality of adjustment holes 132, allowing the effective lengths of the third and fourth links 126, 128 to be readily adjusted.

The support member 102 may be a rigid structural member, such as a steel rod or plate. If the support member 102 is rigid, then the back support 70 is translated only by rotation of the backrest assembly 30. Alternatively, a linear actuator (not illustrated) may be used as the support member 102. Unactivated, and locked at given length, the linear actuator would function identically as a rigid structural member, allowing the back support 70 to translate in response to rotation of the backrest assembly 30. But the linear actuator could also be controlled by the user and operated independently of rotation of the backrest assembly 30 allowing the back support 70 to translate independently of rotation of the back frame 60.

From this disclosure, it will be recognized that in the first preferred embodiment back support translation mechanism 90, the second portion 110 fundamentally operates to magnify movement of the first portion 100 relative to the base 40 as the first portion 100 (and back frame 60) rotates relative to the base 40 and to transmit that magnified motion to the back support 70. Means other than the linkage 120 could be substituted to accomplish the result of transferring motion of the first portion 100 into motion of the back support 70. For example, a gear system (not illustrated) could be operatively coupled to the first portion 100, the second portion 110, and the back support 70, such that movement of the first portion 110 drives the gear system (not illustrated) to translate the back support 70 relative to the back frame 60. Furthermore, the gear system could be provided with a gear ratio such that movement of the back support 70 is greater than movement of the second portion 110. As a further alternative, if movement of the first portion 100 is sufficient, a spring device coupled directly to the back support 70 could be employed as the second portion 110.

In short, from this disclosure the person of ordinary skill in the pertinent art will recognize that any of various mechanisms pivotally coupled at a first end to the back frame and pivotally coupled to the base at a second end and coupled to the back support at a point intermediate the first and second ends could also be used. The mechanisms have a length from the first end to the second end, the length being variable. Rotation of the back frame relative to the base varies the length of the mechanism. The mechanism is operably coupled to the back support to translate the back support relative to the back frame as the length of the mechanism varies.

Figure 8:
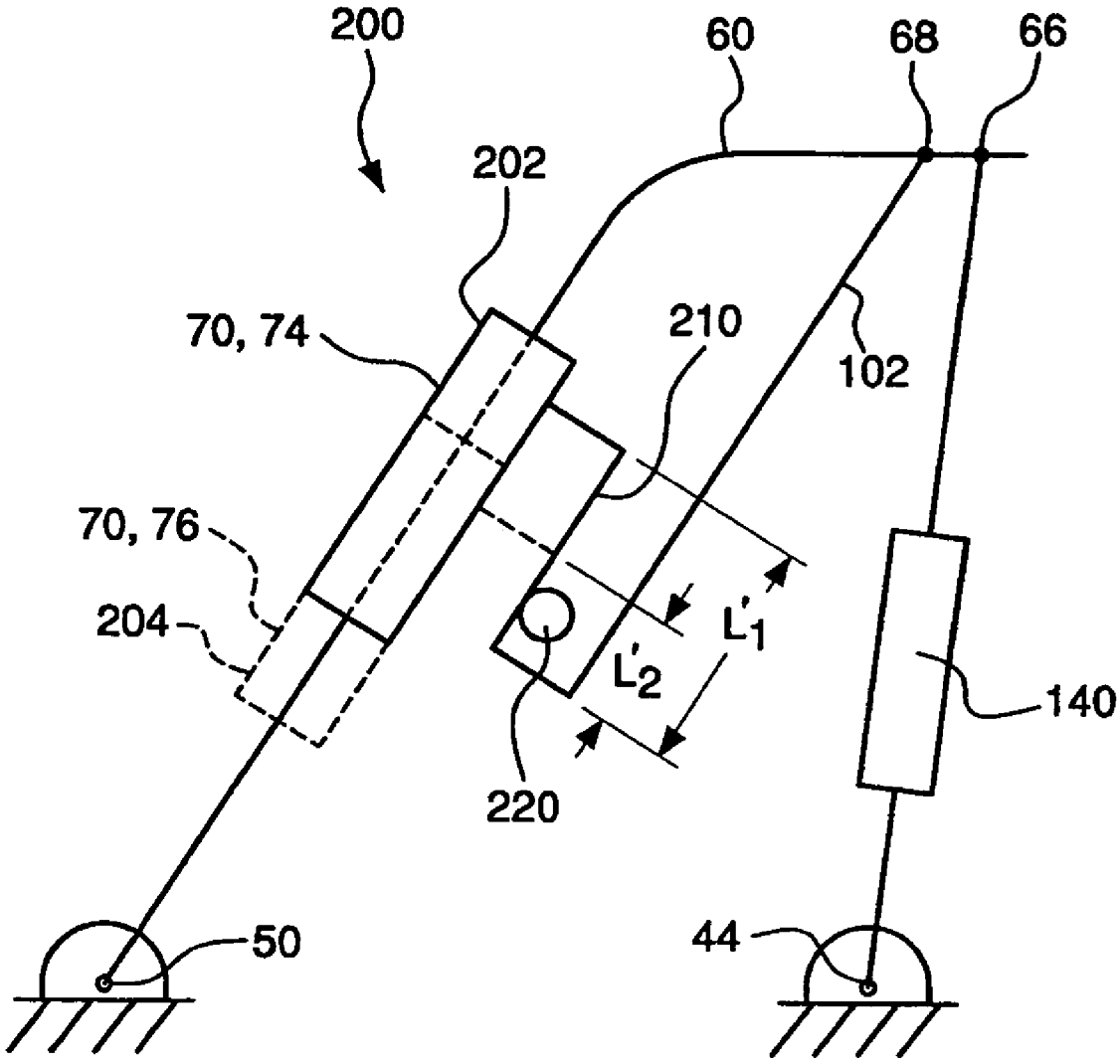
FIG. 8 is a schematic representation of a backrest assembly having a back support translation mechanism in accordance with a second preferred embodiment of the present invention.
Figure 9:
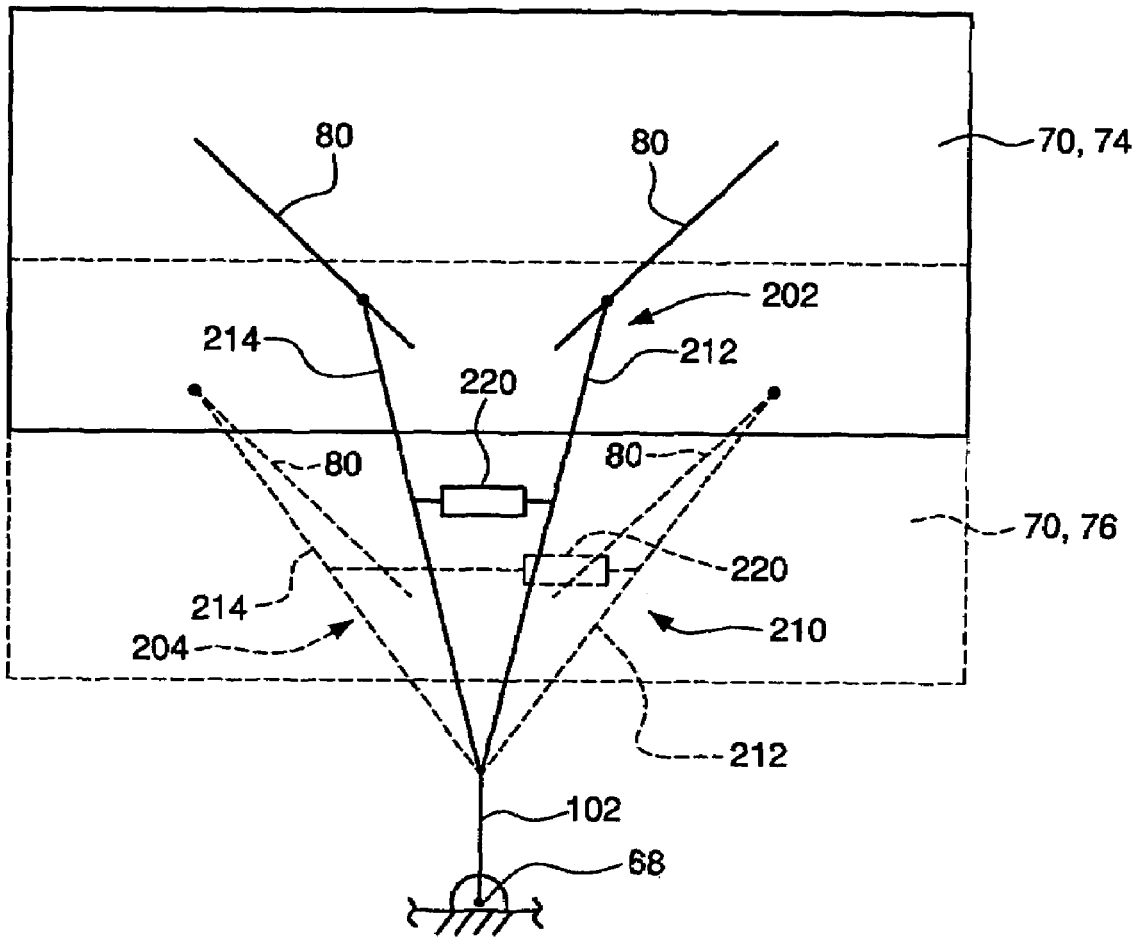
FIG. 9 is a schematic representation of the back support translation mechanism of FIG. 8.

With reference now to FIGS. 8 and 9, a second preferred embodiment back support translation mechanism 200 may be incorporated into the reclining seat assembly 10, replacing the first embodiment back support translation mechanism 90. The second embodiment back support translation mechanism 200 has a raised position 202 and a lowered position 204, and comprises a linkage 210 having a first link 212 and a second link 214 and further comprises a second actuator 220 in addition to the first actuator 140. The first and second links 212, 214 each have a first end and a second end, and are preferably rotatably coupled to the support member 102 at their respective first ends and slidably coupled at their second ends to the back support tracks 80 by the followers 130. The second actuator 220 is coupled at a first end to the first link 212 and at a second end to the second link 214 to rotate the first and second links 212, 214 relative to one another. The second actuator 220 is thus coupled to the back support 70 through the first and second links 212, 214, the followers 130 and the tracks 80. The second actuator 220 is preferably electrically operated and operatively coupled to the battery 302.

In operation, rotation of the first and second links 212, 214 by the second actuator 220 causes the first ends of the links 212, 214 to move within the first and second tracks 80, causing translation of the back support 70 relative to the back frame 60. The second actuator 220 may be operated independently of rotation of the backrest assembly 30. The second actuator 220 may be selectively controllable by a user, using conventional control devices and techniques well known to persons of ordinary skill in the art of control of electromechanical devices. Preferably, operation of the second actuator 220, to control translation of the back support 70, is automatically coordinated with operation of the first actuator 140, controlling rotation of the back frame 60, such that the back support 70 is automatically moved an appropriate amount in proportion to the degree of rotation of the back frame 60.

Linkage 210 has a length from the first ends of links 212 and 214 to the second ends of the links 212 and 214 in a direction extending generally parallel to the plane of back support 70. With particular reference to FIG. 8, this length is variable, with a first length L1' (corresponding to the back support 70 being in its upright position 74) being greater than a second length L2' (corresponding to the back support 70 being in its reclined position 76).

A reclining chair having a movable back support is thus disclosed, providing novel, simple and robust mechanisms capable of translating the back support relative to a back frame. In one embodiment, movement of the back support is driven by rotation of the back frame. In a second embodiment, movement of the back support is driven by an actuator coupled to the back support by a linkage, allowing the back support to be moved independently of the back frame.

Although the invention has been described and illustrated with respect to the exemplary embodiments thereof, it should be understood by those skilled in the art that the foregoing and various other changes, omissions and additions may be made therein and thereto, without parting from the spirit and scope of the present invention. Accordingly, reference should be made to the appended claims, rather than to the foregoing specification, as indicating the scope of the invention.

What is claimed is:

1. A reclining seat comprising:

a base;

a back frame pivotally coupled to the base for rotation about a first pivot axis;

a back support slidingly coupled to the back frame for translation relative to the back frame;

a mechanism including a support member and a second portion, the support member pivotally coupled at a first support end to the back frame at a first connection point and coupled to the second portion at a second support end, the second portion having a first end pivotally coupled to the base at a second connection point for rotation about a second pivot axis and having a second end coupled to the back support, the second portion having a length from the first end to the second end in a directionextending between the first and second connection points, the length of the second portion being variable, wherein rotation of the back frame relative to the base varies the length of the second portion and translates the back support relative to the back frame.

2. The reclining seat of claim 1, wherein the support member is a linear actuator, and operation of the linear actuator is selectively controllable allowing the back support to translate independently of rotation of the back frame.

3. The reclining seat of claim 1, wherein the back frame is coupled to the base at a first frame end and rotation of the back frame relative to the base from an upright position into a reclined position translates the back support toward the first frame end.

4. The reclining seat of claim 1 further comprising an actuator coupled to the base and to the back frame to rotate the back frame relative to the base.

5. A reclining seat comprising:

a base;

a back frame pivotally coupled to the base for rotation about a first pivot axis;

a back support slidingly coupled to the back frame for translation relative to the back frame;

a mechanism including a support member and a second portion, the support member pivotally coupled at a first support end to the back frame at a first connection point and coupled to the second portion at a second support end, the second portion having a first end pivotally coupled to the base at a second connection point for rotation about a second pivot axis and having a second end coupled to the back support, the second portion having a length from the first end to the second end in a direction extending between the first and second connection points, the length of the second portion being variable, wherein rotation of the back frame relative to the base varies the length of the second portion and translates the back support relative to the back frame;

the back support including a pair of tracks, and the second portion including a linkage having first, second, third, and fourth links, each of the links having a first end and a second end, the first and second links being rotatably coupled to the base at their respective first ends and rotatably coupled at their respective second ends to the first ends of the third and fourth links, the third and fourth links being rotatably coupled at points intermediate their first and second ends, and the second ends of the third and fourth links being slidably coupled to the back support tracks.

6. The reclining seat of claim 5, the back support having a lower end proximate the base and an upper end distal the base, and having a central axis extending between the lower and upper ends, wherein each track of the pair of tracks has a longitudinal centerline symmetrically oriented at an angle relative to the back support central axis in generally a V-shaped arrangement.

7. The reclining seat of claim 5, wherein the tracks form generally C-shaped channels and the third and fourth links include follower members received in the channels for movement within the channels.

8. The reclining seat of claim 7, wherein the follower members are rollers that are generally shaped as discs and rotatably mounted to the third and fourth links.

9. A reclining seat comprising:

a base;

a back frame pivotally coupled to the base for rotation about the base along a first pivot axis;

a back support slidingly coupled to the back frame for translation relative to the back frame, the back support having a lower end proximate the base and an upper end distal the base, a central axis extending between the lower and upper ends, a pair of tracks, wherein each track has a longitudinal centerline symmetrically oriented at an angle relative to the back support central axis in generally a V-shaped arrangement;

a linkage formed by first, second, third, and fourth links, each of the links having a first end and a second end, the first and second links being rotatably coupled to the base at their respective first ends and rotatably coupled at their respective second ends to the first ends of the third and fourth links, the third and fourth links being rotatably coupled at points intermediate their first and second ends, and the second ends of the third and fourth links being slidably coupled to the tracks of the back support;

a support member pivotally coupled at a first support end to the back frame and coupled at a second support end to the linkage; and an actuator coupled to the base and, to the back support frame to rotate the back support frame relative to the base, wherein rotation of the back frame relative to the base from an upright position into a reclined position translates the back support toward the first pivot axis of the back frame.

10. A reclining seat comprising:

a base;

a back frame pivotally coupled to the base for rotation about a first pivot axis;

a back support slidingly coupled to the back frame for translation relative to the back frame;

an actuator extending between and pivotally coupled to the base and back frames, the actuator operable to rotate the back frame relative to the base about the first pivot axis between an upright position and a reclined position; and a mechanism pivotally coupled at a first end to the back frame and pivotally coupled to the base at a second end for rotation about a second pivot axis and coupled to the back support at a point intermediate the first and second ends, the mechanism having a length from the first end to the second end, the length being variable based on the angle of the back frame relative to the base, wherein the length of the mechanism decreases to slide the back support along the back frame towards the base when the back frame is rotated by the actuator toward the reclined position, and the length of the mechanism increases to slide the back support along the back frame away from the base when the back frame is rotated by the actuator toward the upright position.

* * * * *